United States Patent [19]

Blaszak

[11] 4,309,803

[45] Jan. 12, 1982

[54] LOW COST FOAM ROLL FOR ELECTROSTATOGRAPHIC REPRODUCTION MACHINE

[75] Inventor: Joseph R. Blaszak, East Rochester, N.Y.

[73] Assignee: Xerox Corporation, Stamford, Conn.

[21] Appl. No.: 191,579

[22] Filed: Sep. 29, 1980

[51] Int. Cl.[3] ..... G03G 15/06

[52] U.S. Cl. ..... 29/130; 29/132; 118/651; 355/3 R

[58] Field of Search ..... 29/132, 130, 110.5; 355/3 R; 427/58; 118/651, 661, DIG. 15

[56] References Cited

U.S. PATENT DOCUMENTS

| | | | |
|---|---|---|---|
| 2,807,233 | 9/1957 | Fitch | 118/638 |
| 3,386,124 | 6/1968 | Feine | 29/110.5 X |
| 3,781,105 | 11/1972 | Meagher | 430/126 X |
| 3,866,572 | 2/1975 | Gundlach | 118/651 |
| 3,942,888 | 3/1976 | Maksymiak et al. | 430/126 X |
| 3,959,573 | 5/1976 | Eddy et al. | 427/58 X |
| 3,959,574 | 5/1976 | Seanor et al. | 427/58 X |
| 4,058,879 | 11/1977 | Lentz et al. | 427/58 X |
| 4,062,812 | 12/1977 | Safford et al. | 427/58 X |

FOREIGN PATENT DOCUMENTS

| | | | |
|---|---|---|---|
| 403412 | 12/1933 | United Kingdom | 118/DIG. 15 |

*Primary Examiner*—Evan K. Lawrence

[57] ABSTRACT

A novel conformable foam roll for use in the electrostatographic reproducing process and machines, and an inexpensive method for making such a roll, are provided. The foam roll is made of a conductive core, which is in turn made of a paper base having a layer of a conductive material thereon, a compressible foam layer formed in situ on said core, and a smooth exterior surface layer on the foam layer.

11 Claims, 3 Drawing Figures

LOW COST FOAM ROLL FOR ELECTROSTATOGRAPHIC REPRODUCTION MACHINE

This invention relates to electrostatographic reproduction process and machines, and more particularly, to inexpensive conformable foam rolls for use therein.

BACKGROUND OF THE INVENTION AND PRIOR ART STATEMENT

The electrostatographic reproduction process for making high quality copies of documents is now well known. For example, in FIG. 1 of Imperial et al U.S. Pat. No. 4,083,093, there is shown a schematic illustration of an automatic xerographic reproducing machine. Briefly, the xerographic reproducing machine includes a photoconductive insulator, sometimes referred to as the photoreceptor, on which the imaging process is to take place. The photoreceptor is successively passed through a series of processing stations at which the following processes take place: at a charging station, where a uniform electrostatic charge is deposited on the photoreceptor; at an exposure station, where a light pattern of an original document to be reproduced is projected onto the charged photoreceptor to form a latent electrostatic image; at a developing station, where the latent electrostatic image is developed with developing material to form a toner powder image; at a transfer station, where the toner powder image is transferred from the photoreceptor to a support sheet; and at a cleaning and discharge station, where the photoreceptor is cleansed of residual toner particles and electrostatic charge. The support sheet carrying the toner powder image is passed through a fusing station where a fuser roll and a pressure roll cooperate to fuse the toner powder image onto the support sheet. For a more detailed explanation of such an xerographic reproducing machine, reference is made to FIG. 1 of said U.S. Pat. No. 4,083,093, and the related disclosure therein.

As indicated in Fitch U.S. Pat. No. 2,807,233, there are uses in the so-called xerographic machines for rollers which are made of an inner-metallic portion and an outer portion of resilient or yielding material having a high electrical resistance. In said Fitch patent, such a roller is shown to be used in the transfer of the toner powder image from the photoreceptor drum onto the print receiving web. In addition, the same patent also shows the use of such a roller as the charging device for charging the photoreceptor drum prior to the exposure of the original to form an electrostatic latent image on the drum. It is clear, therefore, that a roller having an inner portion that is electrically conductive and an outer portion that is resilient and having an appropriately high electrical resistance have several uses in the electrophotographic process. In said Fitch patent, the inner portion is said to be metallic, and the outer portion is said to be made of a layer of soft semiconducting rubber.

In Shelffo U.S. Pat. No. 3,520,604, there is disclosed a transfer roll which is made of a conductive rubber having a resistivity in the range of from $10^{16}$–$10^{11}$ ohm-cm. The pressure applied to the transfer roll during the transfer operations is said to be in the range of from 2 pounds to about 8 pounds per square inch of contact area.

In Dolcimascolo et al U.S. Pat. No. 3,702,482, there is disclosed a biasable transfer member which is made of a rigid hollow cylinder of a conductive metal, such as aluminum or the like, having a relatively thick intermediate blanket of elastomeric material, such as a polyurethane rubber thereon, with a relatively thin outer coating of an elastomeric material, such as a polyurethane available under the tradename "Adiprene" from the duPont Company.

In Meagher U.S. Pat. No. 3,781,105, there is disclosed a transfer roller which is made of a central conductive core or axle, an electrically "relaxable" inner layer, and an outer "self-leveling" layer. The roller defines a nip at the point of transfer through which the transfer member is passed.

In Gundlach U.S. Pat. No. 3,866,572, there is disclosed a foraminous electrostatographic transfer system with a roller electrode having an electrically conductive core, such as a solid metal roller, a thick layer of foraminous open cell material, such as open celled polyurethane foam; and an outer coating, such as a 10 mil layer of polyurethane. The present invention provides an inexpensive foam roll, and the method for making such a roll, which is useful as the roller electrode in the transfer system of said Gundlach patent.

In Maksymiak et al U.S. Pat. No. 3,942,888, there is disclosed a stepped transfer roller having a conductive core and a layer of resilient and electrically semiconductive or relaxable material thereon. The layer of resilient material is made to have two end portions with a diameter slightly larger than the diameter of the central portion, so that mechanical pressure bearing on the roll is protected from the central portion by the two end portions, to result in lower "hollow character" transfer defects.

In Eddy et al U.S. Pat. No. 3,959,573, there is disclosed a biasable member which is made of a conductive core and a layer of hydrophobic elastomeric polyurethane thereon. The biasable member of this patent is said to have minimal sensitivity to relative humidity changes, or to have its resistivity remain substantially unchanged when changes in relative humidity occur.

In Seanor et al U.S. Pat. No. 3,959,574, there is disclosed a biasable member having controlled resistivity. The biasable member of this patent is made of a conductive core having a coating of an elastomeric polyurethane thereon which contains ionic additives capable of altering or controlling the resistivity to within the preferred resistivity range.

In Lentz et al U.S. Pat. No. 4,058,879, there is disclosed butadiene copolymers having a solubilized conductivity control agents incorporated therein, said copolymers are useful in xerographic devices where control of conductivity and/or relaxation behavior is important.

In Safford et al U.S. Pat. No. 4,062,812, there is disclosed a method for expending the electrical life of copolymers of butadiene and terminally unsaturated hydrocarbon nitriles by incorporating salts having asymmetrical quaternary ammonium cations or salts having structural charge specific anions therein.

Finally, in Lentz et al U.S. Pat. No. 4,116,894, there is disclosed butadiene copolymers having solubilized conductivity control agents incorporated therein, and that the electrical life of such copolymers can be enhanced by varying specified quantities of terminally unsaturated hydrocarbon nitriles in the copolymers.

From the foregoing, it can be seen that there is a continuing need for improved conformable rolls for use in the electrostatographic reproducing process and machines, which are inexpensive to make, which possess the requisite conductivity in the core or central portions, and which have the requisite electrical resistivity in the outer portion or layer.

These and other objects of the invention can be gathered from the following disclosure.

SUMMARY OF THE INVENTION

In accordance with the present invention, there is provided a novel conformable roll for use in the electrostatographic reproducing process and machines, which comprises a conductive core, made of a paper base having a layer of a conductive material thereon, a compressible foam layer formed in situ on said core, and a relatively smooth exterior surface layer on the foam layer.

DETAILED DESCRIPTION OF THE INVENTION

As indicated above, the present invention provides a novel and inexpensive roller for use in the electrostatographic copying process, which has an inner portion that is electrically conductive and an outer portion that is resilient and with an appropriately high electrical resistance. As shown in said Fitch U.S. Pat. No. 2,807,233, such a roller has more than one possible use in an electrostatographic copying process. Moreover, as disclosed in said Gundlach U.S. Pat. No. 3,866,572, a resilient roller having an electrically conductive core and a relatively thick layer of foraminous open cell material over the core, and an outer coating, may be used as the roller electrode in the transfer system of an electrostatographic copying process. Accordingly, there is a continuing need for improved and inexpensive compressible rolls having a conductive core and a foam layer on the core having relatively high electrical resistivity.

In accordance with the present invention, there is provided a novel and inexpensive conformable roll, and the method for making such a roll, for use in an electrostatographic copying process. The novel roll of the invention is made of a conductive core formed by a paper base with a layer of conductive material adhering to the surface of the paper base, and a foam layer formed in situ on said conductive core, within an outer smooth surface layer on the foam layer. The paper base for the conductive core is inexpensive and relatively light in weight as compared to a metallic core of the prior art.

Figure 1:
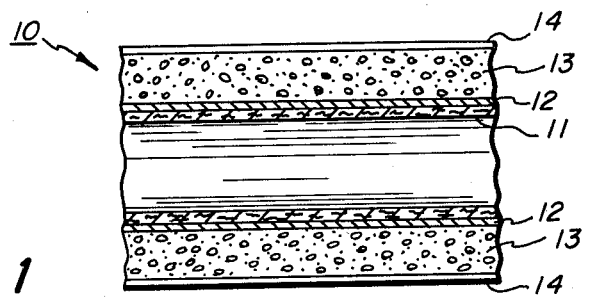
FIG. 1 shows the novel conformable roll of the present invention in a partial cross-sectional view.

Referring to FIG. 1 herein, a foam roll 10 according to the present invention is shown in a partial cross-sectional view. The foam roll 10 is made of a core 11, which in this embodiment is made of a paper tube. Preferably, the paper tube is impregnated with a resin, such as a phenolic resin, to impart hardness and structural rigidity to the paper. Such phenolic resins are known to the art. A conductive layer 12 is adhered to the paper base 11. The conductive layer 12 may be made of any suitable conductive material, but it is preferred to make the conductive layer 12 out of a metallic material. Particularly preferred material for the conductive layer 12 are the commonly available metal foils, such as aluminum foils. A foam layer 13 is located on the conductive layer 12. The foam layer 13 is formed in situ on the conductive layer 12 for a number of reasons: The foam layer 13 can be made to adhere extremely well to the conductive layer 12; the thickness of the foam layer 13 can be accurately controlled; and the smooth surface layer 14 can be made from the foaming material. Of course, the formation of the foam layer in situ makes the roll less expensive to produce. As shown in FIG. 1, a smooth surface layer 14 is positioned on the outer surface of foam layer 13. The smooth surface layer 14 prevents foreign materials, such as dirt, toner particles, etc., from entering into the foam layer. Moreover, the foam layer 13 is relatively easily damaged or torn during operation and the smooth surface layer 14 serves as a protective layer. Another function of the smooth surface layer 14 is to provide a smooth surface for the carrying out of the electrostatographic copying processing step in which the foam roll 10 is being used. Other reasons for providing the smooth surface layer 14 may be gathered from said Gundlach U.S. Pat. No. 3,866,572.

The smooth surface layer 14 may be formed during the in situ foaming process for making the foam layer 13. For example, during the in situ foaming process, the outer periphery of the foam layer may be contacted with a smooth surface, for example, an aluminum or stainless steel surface, maintained at a temperature which is generally lower than the temperature of the foaming mass, to form the smooth surface layer 14. The formation of a skin on a foaming material, by collapsing the cells of the foam at and near the surface of the foaming mass, is also known in the art.

As can be gathered from the above disclosure, the present invention provides an extremely inexpensive roll, and a method for making such a roll, which is useful in the electrostatographic copying process.

Figure 2:
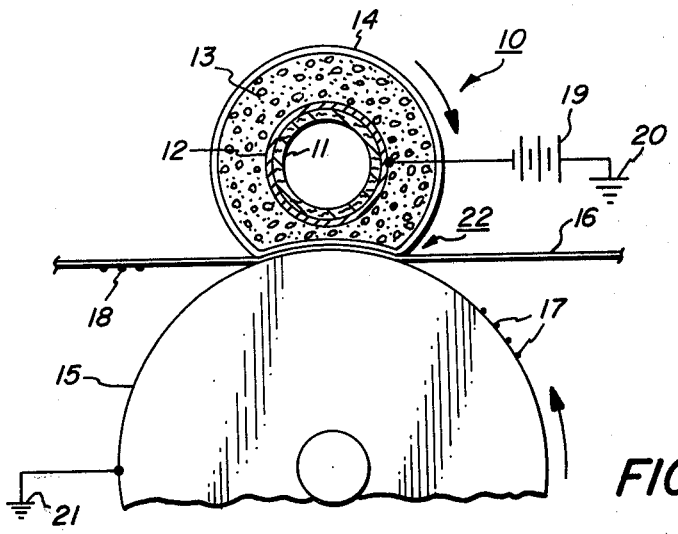
FIG. 2 shows the novel conformable roll of FIG. 1 used in a transfer mode in an electrostatographic copying process.

Referring to FIG. 2, a foam roll 10 made in accordance with the present invention is shown to be used in the transfer process in an electrostatographic copying machine. The physics involved in using a compressible roll for the transfer step in such a process has been discussed in detail in said Gundlach U.S. Pat. No. 3,866,572. In FIG. 2, a foam roll 10 of the present invention is shown to have its conductive layer 12 connected to a source of voltage 19 which is in turn connected to a ground 20. A photoconductive insulating surface 15, in the form of a peripheral surface on a drum, is shown to be in operative engagement with the foam roll 10. On the photoconductive insulating surface 15, a powder toner image 17 was previously formed and developed in accordance with conventional electrostatographic copying process (not shown). A support sheet 16, for example, a sheet of paper, for receiving the powder toner image 17 is passed through the nip 22 formed in the area of contact between foam roll 10 and the photoconductive insulating surface 15. After passing through the nip 22, the powder toner image is transferred to the support sheet 16 and appears as the transferred image 18. The transferred image 18 on the support sheet 16 may be then further processed, for example, by fusing the image onto the support sheet. Photoconductive insulating surface 15 is grounded through a ground 21. It will be noted that in the nip 22, the foam roll 10 is subjected to a compressive force, applied by means not shown, which causes the compression of the foam layer 13 to a fraction of its original thickness. Depending on the nature of the foam layer 13 and the compressive force applied, the foam layer may be compressed for example, to one-half to one-fifth of its original thickness. This compression of the foam layer 13 brings the conductive layer 12 of foam roll 10 into much closer proximity to the photoconductive insulating surface 15, on which the powder toner image 17 is located. As explained in said Gundlach U.S. Pat. No. 3,866,572, such compression of the foam layer with the resultant shortening of the distance or gap between the conductive layer on the core of the transfer roll and the image support surface results in greatly increased field strength in that gap.

Thus, by providing a foam layer which is compressible, and by compressing that foam layer to a small fraction of its original thickness in the transfer nip, the voltage required of the source 19 to effect transfer of the toner image is much smaller. For example, the foam layer of the transfer roll may be compressed to about one-fifth its original thickness. Correspondingly, the voltage required to effect the transfer operation may be reduced from, for example, 3000 volts to several hundred volts.

Figure 3:
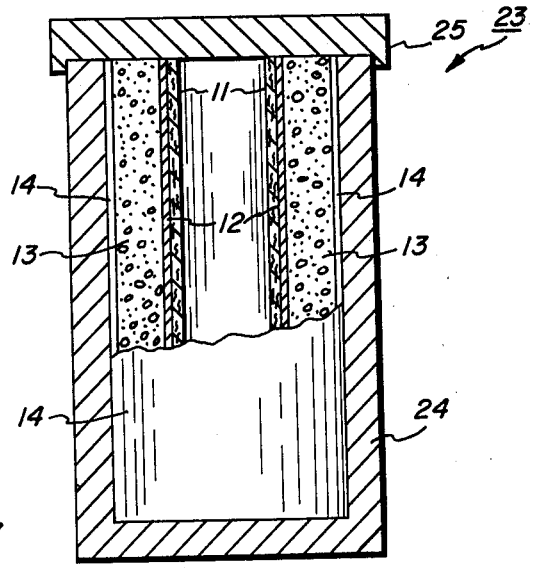
FIG. 3 shows a mold in which the conformable roll of the present invention may be made.

Referring now to FIG. 3, a partial cross-sectional view of the mold suitable for use in making the novel compressible roll of the present invention is shown. In FIG. 3, a mold 23 is shown to be made of a bottom hollow portion 24 and a cover 25. With the cover 25 removed, a central cavity in the hollow portion 24 is exposed. A paper core 11, previously impregnated with a phenolic resin and covered with a conductive layer 12 made of an aluminum foil, is inserted into this cavity and centrally positioned therein. A polyurethane foam formulation was then introduced into the space between the outer surface of the conductive layer 12 and the interior surface of the cavity. A typical formulation for such purpose may be one made of: 100 parts by weight a polyether triol of 3000 molecular weight; 38 parts by weight of toluene diisocyanate; 0.5 part by weight stannous octoate; 0.5 part by weight N-ethylmorpholine; 0.1 part by weight tetramethyl-1,3-butane diamine; 1 part by weight of a foam stabilizer such as a silicone copolymer; and 2.9 parts by weight of water as a blowing agent. Other polyurethane formulations may be employed. For example, polymethylene tetraglycol may be used as the polyol in place of the polyether triol. A charge control agent, for example, tetraheptyl ammonium bromide, may be incorporated into the foam formulation to decrease the electrical resistivity of the foam from about $10^{13}$ ohm/cm to about $10^{9}$ ohm/cm. The amount of the charge control agents which may be used is about 0.1 to 10% by weight of the foam formulation. Preferably, about 2 to 5% by weight of the charge control agent is used. I particularly prefer to use about 3% by weight of the charge control agent.

Referring again to FIG. 3, after the introduction of the foam formulation, the foaming process is allowed to proceed at room temperature, and the process is essentially over in about one minute's time. When the foam has formed sufficiently to come into contact with the interior surface of the cavity in the hollow portion of the mold, a smooth surface layer 14 or a skin on the foam layer may be formed by controlling the temperature of the interior surface of the cavity. This temperature may be controlled by passing a coolant into the interior conduits (not shown) in the hollow portion 24 of the mold. Typically, the cavity surface may be maintained at a temperature between about 25° to 100° C. to form skins of various thicknesses. For example, at a cavity surface temperature of about 25° C., a skin as thick as ½ inch may be formed. Conversely, at about 95° C., a skin as thick as 0.03 to 0.06 inch may be formed. At about 110° C., virtually no skin would be formed on the foam surface. The thickness of the smooth surface layer 14 desired is to some extent dependent upon the thickness of the foam layer 13. Generally, the foam layer is preferably made between about 0.25 inch to 0.75 inch in thickness. The thickness of the foam layer is, in turn, to some extent affected by the size of the core. As indicated above, the core may be made of a phenolic resin impregnated paper tube, which is available, for example, from the Budd Company. Such paper tubes are typically made of a Kraft paper 0.06 inch in thickness, with a diameter of about 0.75 inch to about 3 inches. When a 2 inch diameter paper tube is used, I prefer to use a foam layer 13 about ⅜ inch thick. The smooth surface layer 14 may then be about 1–5 mils in thickness. I particularly prefer a smooth surface layer of about 3–4 mils.

Referring again to FIG. 3, generally it takes only a few minutes for the skin to form during the foaming process, for example, 5 to 10 minutes. After the foaming reaction has stopped, the conformable foam roll of the present invention may be removed from the mold. The foam layer of the roll generally has a closed-cell structure, but due to the relative thinness of the foam layer it is compressible. Preferably, a mold release agent, such as any one of a number of silicone oils well known to the art, is used in the cavity to assist in the removal of the roll.

It is to be understood that the mold shown in FIG. 3 represents only one embodiment of the present method for making the foam roll. For example, the core may be mounted for rotation during the foaming process and the foam formulation is added to the surface of the core while it is being rotated. In this manner, the distribution of the foam formulation around the circumference of the core is made to be more uniform.

While the invention has been described in detail with reference to specific preferred embodiments, it will be appreciated that various modifications may be made from the specific details without departing from the spirit and scope of the invention.

What is claimed is:

1. An inexpensive conformable roll for use in an electrostatographic copying machine which comprises a conductive core made of a paper base having a layer of a conductive material thereon, a compressible foam layer formed in situ on said core, and an outer smooth surface layer on said foam layer.

2. An inexpensive conformable roll according to claim 1 wherein said outer smooth surface layer is integral with said foam layer and is produced during the in situ foaming process.

3. An inexpensive conformable roll according to claim 2 wherein said paper base is impregnated with a resin and wherein said layer of conductive material is a thin metallic layer.

4. An inexpensive conformable roll according to claim 3 wherein said paper base is a paper tube impregnated with a phenolic resin, and wherein said layer of conductive material is an aluminum foil.

5. An inexpensive conformable roll according to claim 3 wherein said foam layer is made of a urethane foam.

6. An inexpensive conformable roll according to claim 5 wherein said outer smooth surface layer is made by contacting the foaming urethane layer with a smooth surface maintained at a temperature of about 25°–110° C.

7. An inexpensive conformable roll according to claim 5 wherein said urethane foam is made of toluene diisocyanate and a polyether triol.

8. An inexpensive conformable roll according to claim 5 wherein said urethane foam layer further includes a charge control additive to decrease the electrical resistivity of the foam.

9. An inexpensive conformable roll according to claim 8 wherein said charge control additive is tetraheptyl ammonium bromide.

10. An inexpensive conformable roll according to claim 8 wherein said charge control additive is present in an amount of about 2 to 5 percent by weight of the foam formulation.

11. An inexpensive conformable roll according to claim 5 wherein said conductive core is a phenolic resin impregnated paper tube having a layer of an aluminum foil thereon, a foam layer of about ⅜ inch thick polyurethane foam on said core, and a smooth surface layer of about 3 to 4 mils thick skin formed on said foam layer during the in situ foaming process.

* * * * *